US009068127B2

(12) United States Patent
Mezza et al.

(10) Patent No.: US 9,068,127 B2
(45) Date of Patent: Jun. 30, 2015

(54) PROCESS FOR REMOVING SULFUR COMPOUNDS FROM VACUUM GAS OIL

(71) Applicant: UOP LLC, Des Plaines, IL (US)

(72) Inventors: Beckay J. Mezza, Arlington Heights, IL (US); Alakananda Bhattacharyya, Glen Ellyn, IL (US); Christopher P. Nicholas, Evanston, IL (US); Haiyan Wang, Hoffman Estates, IL (US)

(73) Assignee: UOP LLC, Des Plaines, IL (US)

( * ) Notice: Subject to any disclaimer, the term of this patent is extended or adjusted under 35 U.S.C. 154(b) by 163 days.

(21) Appl. No.: 13/796,881

(22) Filed: Mar. 12, 2013

(65) Prior Publication Data

US 2014/0001088 A1 Jan. 2, 2014

Related U.S. Application Data

(60) Provisional application No. 61/666,047, filed on Jun. 29, 2012.

(51) Int. Cl.

| | |
|---|---|
| ***C10G 29/02*** | (2006.01) |
| ***C10G 67/04*** | (2006.01) |
| ***C10G 21/28*** | (2006.01) |
| ***C10G 21/06*** | (2006.01) |
| ***C10G 21/08*** | (2006.01) |
| *C10G 29/00* | (2006.01) |
| *C10G 29/06* | (2006.01) |

(52) U.S. Cl.

CPC ..... *C10G 29/06* (2013.01); *C10G 67/04* (2013.01); *C10G 21/28* (2013.01); *C10G 21/06* (2013.01); *C10G 21/08* (2013.01); *C10G 2300/1074* (2013.01)

(58) Field of Classification Search

CPC ..... C10G 29/00; C10G 29/02; C10G 29/06
USPC ..... 208/208 R, 236–237, 240, 254 R, 279, 208/290, 292
See application file for complete search history.

(56) References Cited

U.S. PATENT DOCUMENTS

| | | | | |
|---|---|---|---|---|
| 7,001,504 | B2 * | 2/2006 | Schoonover | 208/236 |
| 7,553,406 | B2 | 6/2009 | Wasserscheid et al. | |
| 2003/0085156 | A1 | 5/2003 | Schoonover | |
| 2004/0045874 | A1 | 3/2004 | Olivier-Bourbigou et al. | |
| 2011/0155637 | A1 | 6/2011 | Serban et al. | |
| 2011/0155638 | A1 | 6/2011 | Bhattacharyya et al. | |
| 2014/0001099 | A1 | 1/2014 | Mezza et al. | |

OTHER PUBLICATIONS

Speight, J.G. (1999). The Chemistry and Technology of Petroleum, 3rd ed, Marcel-Dekker, 918 pgs [Office action cites pp. 607-609].*
Search Report dated Nov. 21, 2013 for corresponding PCT application.

* cited by examiner

*Primary Examiner* — Brian McCaig

(57) ABSTRACT

A process for removing a nitrogen compound and a sulfur compound from a hydroprocessed vacuum gas oil feed includes contacting the hydroprocessed vacuum gas oil feed comprising the nitrogen compound and the sulfur compound with a VGO-immiscible phosphonium ionic liquid to produce a hydroprocessed vacuum gas oil and VGO-immiscible phosphonium ionic liquid mixture, and separating the mixture to produce a hydroprocessed vacuum gas oil effluent having a reduced nitrogen compound and sulfur compound content relative to the vacuum gas oil feed. It was found that the amount of the sulfur compound being removed was significantly improved by first removing the nitrogen compounds, especially polar nitrogen compounds.

8 Claims, No Drawings

PROCESS FOR REMOVING SULFUR COMPOUNDS FROM VACUUM GAS OIL

CROSS-REFERENCE TO RELATED APPLICATION

This application claims priority from Provisional Application No. 61/666,047 filed Jun. 29, 2012, the contents of which are hereby incorporated by reference.

BACKGROUND OF THE INVENTION

This invention relates to processes for reducing the sulfur compound content of vacuum gas oils (VGO). More particularly, the invention relates to removing sulfur compounds that are contaminants from VGO using an ionic liquid.

VGO is a hydrocarbon fraction that may be converted into higher value hydrocarbon fractions such as diesel fuel, jet fuel, naphtha, gasoline, and other lower boiling fractions in refining processes such as hydrocracking and fluid catalytic cracking (FCC). The contaminants in VGO such as sulfur, nitrogen, metals and Conradson Carbon cause deactivation of catalysts. Total sulfur removal from feeds down to low ppm levels is an attainable goal. A significant portion of the contaminants are present as highly aromatic polar compounds. Certain phosphonium based ionic liquids have been found to selectively extract these compounds from VGO. Removal of the contaminants from the VGO will have a beneficial impact on downstream processing conditions and have an environmental impact by reducing the NOx and sulfur emissions from the regenerator. Desulfurized feeds can be further processed using noble metal catalysts. Sometimes the contaminant content of VGO feeds are reduced by hydrotreating the feed to remove nitrogen, metals and sulfur prior to further processing. However, this process uses hydrogen, in a costly process step. Additionally, hydroprocessing of feeds reduced in contaminants is significantly easier than processing highly contaminated feeds. It can be envisioned that similar aromatic compounds could be extracted from other hydrocarbon streams as well. However, VGO feed streams having higher amounts of sulfur compounds are more difficult to convert. It is the objective of the current invention to improve the ionic liquid extraction of sulfur compounds by first extracting the more highly aromatic polar nitrogen species from VGO. Experiments have shown that deep de-nitrogenation of VGO can lead to increased selectivity to sulfur removal. One approach to using this idea would be to do serial extractions on untreated VGO to first remove the polar aromatic nitrogen species and continue the operation to remove sulfur as well. Another approach would be to treat hydrotreated VGO in an attempt to remove virtually all of the polar aromatic sulfur and nitrogen species. These species are known to be refractory in hydrotreating processes and are the most likely sulfur and nitrogen species to remain after hydrotreating. This serial extraction could be done using the same ionic liquid, a sequence of different ionic liquids or by combining ionic liquids in a single extraction.

Hydroprocessing includes processes which convert hydrocarbons in the presence of hydroprocessing catalyst and hydrogen to more valuable products.

Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Slurry hydrocracking is a slurried catalytic process used to crack residue feeds to gas oils and fuels. Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking.

Various processes using ionic liquids to remove sulfur and nitrogen compounds from hydrocarbon fractions are known. U.S. Pat. No. 7,001,504 B2 discloses a process for the removal of organosulfur compounds from hydrocarbon materials which includes contacting an ionic liquid with a hydrocarbon material to extract sulfur containing compounds into the ionic liquid. U.S. Pat. No. 7,553,406 B2 discloses a process for removing polarizable impurities from hydrocarbons and mixtures of hydrocarbons using ionic liquids as an extraction medium. U.S. Pat. No. 7,553,406 B2 also discloses that different ionic liquids show different extractive properties for different polarizable compounds. US 20110155637 discloses the removal of nitrogen compounds from vacuum gas oil by use of a VGO-immiscible phosphonium ionic liquid, but none of these processes show utility in removing refractory nitrogen compounds.

There remains a need for improved processes that enable the removal of sulfur compounds in addition to other impurities +from vacuum gas oil (VGO) either before or after hydrotreating or other treatment.

SUMMARY OF THE INVENTION

The present invention is a process for removing sulfur and nitrogen compounds from a vacuum gas oil comprising contacting the vacuum gas oil with a VGO-immiscible phosphonium ionic liquid to produce a processed vacuum gas oil and VGO-immiscible phosphonium ionic liquid mixture, and separating the mixture to produce a processed vacuum gas oil effluent and a VGO-immiscible phosphonium ionic liquid effluent comprising the sulfur and nitrogen compounds. The vacuum gas oil is subjected to additional treatment such as hydroprocessing before or after the contact with the VGO-immiscible phosphonium ionic liquid or between two periods of contact with the VGO-immiscible phosphonium ionic liquid. It has been found that by first extracting the more highly aromatic polar nitrogen species, the extraction of sulfur species becomes more efficient.

The VGO-immiscible phosphonium ionic liquid comprises at least one ionic liquid from at least one of the following ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the VGO-immiscible phosphonium ionic liquid comprises at least one of trihexyl(tetradecyl) phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl) phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate.

There are numerous embodiments of the invention in which a process of treating hydrocarbons involves combinations of ionic liquid extraction and hydrotreating or other treatment.

Other configurations may be employed as well, such as multiple hydrotreating steps and multiple ionic liquid extraction steps in order to produce a product stream with the desired level of purity.

DETAILED DESCRIPTION OF THE INVENTION

In general, the invention may be used to remove a nitrogen compound and a sulfur compound from a hydroprocessed vacuum gas oil (VGO) hydrocarbon fraction through use of a VGO-immiscible phosphonium ionic liquid. The invention may also be used to remove a nitrogen compound and a sulfur compound from a vacuum gas oil prior to hydroprocessing of the vacuum gas oil. More than one type of nitrogen compound and more than one type of sulfur compound may be removed.

The terms "vacuum gas oil", "VGO", "VGO phase" and similar terms relating to vacuum gas oil as used herein are to be interpreted broadly to receive not only their ordinary meanings as used by those skilled in the art of producing and converting such hydrocarbon fractions, but also in a broad manner to account for the application of our processes to hydrocarbon fractions exhibiting VGO-like characteristics. Thus, the terms encompass straight run VGO, as may be produced in a crude fractionation section of an oil refinery, as well as VGO product cuts, fractions, or streams that may be produced, for example, by coker, deasphalting, and visbreaking processing units, or which may be produced by blending various hydrocarbons. In the present invention, the vacuum gas oil is subjected to hydroprocessing, either before or after the use of the ionic liquid to remove a substantial amount of nitrogen compounds and sulfur compounds.

The term "hydroprocessing" as referred to herein includes both hydrocracking and hydrotreating. Hydrocracking refers to a process in which hydrocarbons crack in the presence of hydrogen to lower molecular weight hydrocarbons. Hydrocracking also includes slurry hydrocracking in which resid feed is mixed with catalyst and hydrogen to make a slurry and cracked to lower boiling products. VGO in the products may be recycled to manage coke precursors referred to as mesophase. Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. However, it has been found that hydrotreating is ineffective in removal of certain refractory heteroatoms.

In general, VGO comprises petroleum hydrocarbon components boiling in the range of from about 100° to about 720° C. In an embodiment the VGO boils from about 250° to about 650° C. and has a density in the range of from about 0.87 to about 0.95 g/cm$^3$. In another embodiment, the VGO boils from about 95° to about 580° C.; and in a further embodiment, the VGO boils from about 300° to about 720° C. Generally, VGO may contain from about 100 to about 30,000 ppm-wt nitrogen. In an embodiment, the nitrogen content of the VGO ranges from about 10 to about 20000 ppm-wt. The nitrogen content may be determined using ASTM method D4629-02, Trace Nitrogen in Liquid Petroleum Hydrocarbons by Syringe/Inlet Oxidative Combustion and Chemiluminescence Detection. Unless otherwise noted, the analytical methods used herein such as ASTM D4629-02 are available from ASTM International, 100 Barr Harbor Drive, West Conshohocken, Pa., USA.

Processes according to the invention remove nitrogen compounds and then sulfur compounds from vacuum gas oil. That is, the invention removes at least one nitrogen compound and at least one sulfur compound. It is understood that vacuum gas oil will usually comprise a plurality of nitrogen compounds and a plurality of sulfur compounds of different types in various amounts. The invention may remove the same or different amounts of each type of nitrogen compound and sulfur compound, and some types of nitrogen and sulfur compounds may not be removed. The sulfur content of the vacuum gas oil is reduced by at least 10 wt % and in some instances at least 20 wt %. The sulfur content of the vacuum gas oil may be reduced by at least 25 wt % and in some instances by greater than 30 wt %.

One or more ionic liquids are used to extract one or more nitrogen compounds and then one or more sulfur compounds from VGO. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms such as nitrogen, phosphorous, sulfur, arsenic, boron, antimony, and aluminum, and the anions may be any inorganic, organic, or organometallic species.

Ionic liquids suitable for use in the instant invention are VGO-immiscible phosphonium ionic liquids. As used herein the term "VGO-immiscible phosphonium ionic liquid" means an ionic liquid having a cation comprising at least one phosphorous atom and which is capable of forming a separate phase from VGO under operating conditions of the process. Ionic liquids that are miscible with VGO at the process conditions will be completely soluble with the VGO; therefore, no phase separation will be feasible. Thus, VGO-immiscible phosphonium ionic liquids may be insoluble with or partially soluble with VGO under operating conditions. A phosphonium ionic liquid capable of forming a separate phase from the vacuum gas oil under the operating conditions is considered to be VGO-immiscible. Ionic liquids according to the invention may be insoluble, partially soluble, or completely soluble (miscible) with water.

The VGO-immiscible phosphonium ionic liquid comprises at least one ionic liquid from at least one of the following groups of ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halide. More specifically, the VGO-immiscible phosphonium ionic liquid comprises at least one of trihexyl(tetradecyl)phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate. In a further embodiment, the VGO-immiscible phosphonium ionic liquid is selected from the group consisting of trihexyl(tetradecyl)phosphonium chloride, trihexyl(tetradecyl)phosphonium bromide, tributyl(methyl) phosphonium bromide, tributyl(methyl)phosphonium chloride, tributyl(hexyl)phosphonium bromide, tributyl(hexyl) phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, tetrabutylphosphonium methanesulfonate, and combinations thereof. The VGO-immiscible phosphonium ionic liquid may be selected from the group consisting of trihexyl(tetradecyl)phosphonium halides, tetraalkylphosphonium dialkylphosphates, tetraalkylphosphonium tosylates, tetraalkylphosphonium sulfonates, tetraalkylphosphonium halides, and combinations thereof. The VGO-immiscible phosphonium ionic liquid may comprise at least one ionic liquid from at least one of the following groups of ionic liquids trihexyl(tetradecyl)phosphonium halides, tetraalkylphosphonium dialkylphosphates, tetraalkylphosphonium tosylates, tetraalkylphosphonium sulfonates, and tetraalkylphosphonium halides.

In an embodiment, the invention is a process for removing nitrogen compounds and sulfur compounds from vacuum gas oil (VGO) comprising a contacting step and a separating step. In the contacting step, vacuum gas oil comprising a nitrogen compound and a sulfur compound and a VGO-immiscible phosphonium ionic liquid are contacted or mixed. The contacting may facilitate transfer or extraction of the one or more nitrogen compounds from the VGO to the ionic liquid. In general it was found that the nitrogen compounds were first removed, followed by the sulfur compounds. Although a VGO-immiscible phosphonium ionic liquid that is partially soluble in VGO may facilitate transfer of the nitrogen compound from the VGO to the ionic liquid, partial solubility is not required. Insoluble vacuum gas oil/ionic liquid mixtures may have sufficient interfacial surface area between the VGO and ionic liquid to be useful. In the separation step, the mixture of vacuum gas oil and ionic liquid settles or forms two phases, a VGO phase and an ionic liquid phase, which is separated to produce a VGO-immiscible phosphonium ionic liquid effluent and a vacuum gas oil effluent.

The process may be conducted in equipment which are well known in the art and are suitable for batch or continuous operation. For example, in experiments to reduce the present invention to practice in a small, laboratory scale operation of the invention, VGO and a VGO-immiscible phosphonium ionic liquid were mixed in a beaker, flask, or other vessel, e.g., by stirring, shaking, use of a mixer, or a magnetic stirrer. The mixing or agitation is stopped and the mixture forms a VGO phase and an ionic liquid phase which can be separated, for example, by decanting, centrifugation, or use of a pipette to produce a vacuum gas oil effluent having lower nitrogen compound and sulfur compound content relative to the vacuum gas oil. The process also produces a VGO-immiscible phosphonium ionic liquid effluent comprising the one or more nitrogen compounds and one or more sulfur compounds.

The contacting and separating steps may be repeated for example when the nitrogen and sulfur content of the vacuum gas oil effluent is to be reduced further to obtain a desired nitrogen and sulfur level in the ultimate VGO product stream from the process. Each set, group, or pair of contacting and separating steps may be referred to as a nitrogen compound or a sulfur compound removal step. Thus, the invention encompasses single and multiple sulfur and nitrogen removal steps. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The nitrogen compound removal process and the sulfur compound removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used. The equipment may be of an appropriate size or scale to treat the volumes of feed that are to be treated.

In an embodiment of the invention at least one type of nitrogen compound and at least one type of sulfur compound is removed in an extraction zone that comprises a multi-stage, counter-current extraction column wherein vacuum gas oil and VGO-immiscible phosphonium ionic liquid are contacted and separated. Consistent with common terms of art, the ionic liquid introduced to the nitrogen or sulfur removal step may be referred to as a "lean ionic liquid" generally meaning a VGO-immiscible phosphonium ionic liquid that is not saturated with one or more extracted nitrogen compounds or sulfur compounds. Lean ionic liquid may include one or both of fresh and regenerated ionic liquid and is suitable for accepting or extracting nitrogen or sulfur compounds from the VGO feed. Likewise, the ionic liquid effluent may be referred to as "rich ionic liquid", which generally means a VGO-immiscible phosphonium ionic liquid effluent produced by a nitrogen compound or sulfur compound removal step or process or otherwise including a greater amount of extracted nitrogen or sulfur compounds than the amount of extracted nitrogen compounds or sulfur compounds included in the lean ionic liquid. A rich ionic liquid may require regeneration or dilution, e.g. with fresh ionic liquid, before recycling the rich ionic liquid to the same or another nitrogen removal step of the process.

The nitrogen compound and sulfur compound removal steps may be conducted under conditions including temperatures and pressures sufficient to keep the VGO-immiscible phosphonium ionic liquid and VGO feeds and effluents as liquids. For example, nitrogen compound and sulfur compound removal steps will be at a temperature that may range between about 10° C. and less than the decomposition temperature of the phosphonium ionic liquid; and the pressure may range between about atmospheric pressure and about 700 kPa(g). When the VGO-immiscible ionic liquid comprises more than one ionic liquid component, the decomposition temperature of the ionic liquid is the lowest temperature at which any of the ionic liquid components decompose. The nitrogen compound and sulfur compound removal steps may be conducted at a uniform temperature and pressure or the contacting and separating steps may be operated at different temperatures and/or pressures. In an embodiment, the contacting step is conducted at a first temperature, and the separating step is conducted at a temperature at least 5° C. lower than the first temperature. In a non-limiting example, the first temperature is about 80° C. Such temperature differences may facilitate separation of the VGO and ionic liquid phases.

The above and other nitrogen compound and sulfur compound removal step conditions such as the contacting or mixing time, the separation or settling time, and the ratio of VGO feed to VGO-immiscible phosphonium ionic liquid (lean ionic liquid) may vary greatly based, for example, on the specific ionic liquid or liquids employed, the nature of the VGO feed (straight run or previously processed), the nitrogen and sulfur content of the VGO feed, the degree of sulfur and nitrogen compound removal required, the number of steps employed, and the specific equipment used. In general it is expected that contacting time may range from less than one minute to about two hours; settling time may range from about one minute to about eight hours; and the weight ratio of VGO feed to lean ionic liquid introduced to the nitrogen and sulfur removal steps may range from 1:10,000 to 10,000:1. In an embodiment, the weight ratio of VGO feed to lean ionic liquid may range from about 1:1,000 to about 1,000:1; and the weight ratio of VGO feed to lean ionic liquid may range from about 1:100 to about 100:1. In an embodiment the weight of VGO feed is greater than the weight of ionic liquid introduced to the nitrogen and sulfur removal steps.

The amount of water present in the vacuum gas oil/VGO-immiscible phosphonium ionic liquid mixture during the nitrogen compound and sulfur compound removal steps may also affect the amount of nitrogen compounds removed and/or the degree of phase separation, i.e., recovery of the VGO and ionic liquid. In an embodiment, the VGO/VGO-immiscible phosphonium ionic liquid mixture has a water content of less than about 10% relative to the weight of the ionic liquid. In another embodiment, the water content of the VGO/VGO-immiscible phosphonium ionic liquid mixture is less than about 5% relative to the weight of the ionic liquid; and the water content of the VGO/VGO-immiscible phosphonium ionic liquid mixture may be less than about 2% relative to the weight of the ionic liquid. In a further embodiment, the VGO/VGO-immiscible phosphonium ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving nitrogen compound and sulfur compound removal, washing, and regeneration zones may pass through ancillary equipment such as heat exchanges within the zones. Streams, including recycle streams, introduced to washing or extraction zones may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. Examples include: various streams comprising ionic liquid and water may be dried and/or passed to other zones to provide all or a portion of the water and/or ionic liquid required by the destination zone. The various process steps may be operated continuously and/or intermittently as needed for a given embodiment e.g. based on the quantities and properties of the streams to be processed in such steps. As discussed above the invention encompasses multiple nitrogen and sulfur compound removal steps, which may be performed in parallel, sequentially, or a combination thereof. Multiple nitrogen and sulfur compound removal steps may be performed within the same nitrogen and sulfur compound removal zone and/or multiple nitrogen and sulfur compound removal zones may be employed with or without intervening washing, regeneration and/or drying zones.

There are numerous embodiments of the invention in which a process of treating hydrocarbons involves combinations of ionic liquid extraction and hydrotreating. The following are three representative combinations of ionic liquid extraction and hydrotreating.

In one configuration, an ionic liquid extraction step is added after hydrotreating. The ionic liquids remove specific nitrogen compounds that remain that are harmful for downstream catalyst.

In another configuration, ionic liquid extraction is employed to remove a majority of nitrogen compounds before the hydrocarbons enter the hydrotreater. This will enhance the desulfurization efficiency and lower the severity of hydrotreating.

In a third configuration, ionic liquid extraction is conducted both before and after hydrotreating. This encompasses both benefits of the two different combinations shown above but imposes more capital cost. The ionic liquid can be recycled back and forth between two stages of ionic liquid extraction.

In yet another configuration, there may be multiple stages of ionic liquid extraction of nitrogen and sulfur compounds and hydrotreating until the vacuum gas oil has reached a predetermined low level of nitrogen compounds and sulfur compounds.

Other configurations may be employed as well, such as multiple hydrotreating steps and multiple ionic liquid extraction steps in order to produce a product stream with the desired level of purity.

The following examples are illustrative and not limiting.

A digitally controlled Optichem hot plate magnetic stirrer with 17 individual sample wells was used to screen ionic liquids for VGO de-sulfurization. The experiments were conducted in 6 dram vials with ¾ inch cross shaped magnetic stir bars for mixing. For the purposes of the screening study 3 grams of ionic liquid were combined in a vial with 6 grams of VGO, heated to 80° C. and mixed at 300 rpm for 30 minutes. After 30 minutes the mixing was stopped and the samples were held static at 80° C. in successful experiments in which separation occurred and the extracted VGO was suctioned off with a glass pipette. A VGO sample that had been hydrotreated to four different nitrogen levels provided feeds for the de-sulfurization experiments. The hydrotreating process reduced the sulfur and nitrogen, but did not completely remove either species. Analysis of the starting VGO and the 4 hydrotreated samples is shown in Table 1.

TABLE 1

| Feed # | VGO | Hydro-treated VGO Feed 1 | Hydrotreated VGO Feed 2 | Hydrotreated VGO Feed 3 | Hydrotreated VGO Feed 4 |
|---|---|---|---|---|---|
| API | 21.0 | 27.8 | 26.5 | 26.9 | 28.3 |
| S (wt ppm) | 23600 | 724 | 1859 | 1218 | 268 |
| N (wt ppm) | 1354 | 220 | 486 | 362 | 122 |

EXAMPLE 1

A sample of tributyldecylphosphonium chloride was used. 4 g of tributyldecylphosphonium chloride and 8 g of each hydrotreated VGO (HTVGO) sample were combined in 6 dram vials with a stir bar. The vials were placed onto a heated stir plate and stirred at 80° C. for 30 minutes. After 30 minutes, the stirring was stopped and the ionic liquid/HTVGO mixtures were allowed to settle for 30 minutes. The HTVGO material was then separated from the ionic liquid and analyzed for sulfur content. Desulfurization ranged from 20.9 to 28.7% depending on the amount of nitrogen remaining in the HTVGO. Results are shown in Table 2.

TABLE 2

| IL:VGO 1:1/80° C./30 min/500 rpm tributyldecylphosphonium chloride | Hydro-treated VGO Feed 1 | Hydro-treated VGO Feed 2 | Hydro-treated VGO Feed 3 | Hydrotreated VGO Feed 4 |
|---|---|---|---|---|
| N (wt ppm) | 29 | 66 | 47 | 21 |
| S (wt ppm) | 548 | 1475 | 964 | 191 |
| Sulfur removed, wt % | 24.3 | 20.7 | 20.9 | 28.7 |

EXAMPLE 2

A sample of tributylethylphosphonium diethylphosphate was used. 4 g tributylethylphosphonium diethylphosphate and 8 g of each HTVGO were combined in 6 dram vials with a stir bar. The vials were placed onto a heated stir plate and stirred at 80° C. for 30 minutes. After 30 minutes, the stirring was stopped and the ionic liquid/HTVGO mixtures were allowed to settle for 30 minutes. The HTVGO material was then separated from the ionic liquid and analyzed for S content. Desulfurization ranged from 20.9 to 28.7% depending on the amount of nitrogen remaining in the HTVGO. Results are shown in Table 3.

TABLE 3

| IL:VGO 1:1/80° C./30 min/500 rpm tributylethylphosphonium diethylphosphate | Hydro-treated VGO Feed 1 | Hydro-treated VGO Feed 2 | Hydro-treated VGO Feed 3 | Hydrotreated VGO Feed 4 |
|---|---|---|---|---|
| N (wt ppm) | 48 | 146 | 93 | 33 |
| S (wt ppm) | 616 | 1610 | 1055 | 223 |
| Sulfur removed, wt % | 14.9 | 13.4 | 13.4 | 16.8 |

EXAMPLE 3

A mixture of ionic liquids was prepared that contained 80% tributylethylphosphonium diethylphosphate and 20% tetradecyl(trihexyl)phosphonium bromide. 5 grams of the ionic liquid mixture and 5 grams of HTVGO were combined in 6 dram vials. The vials were placed onto a heated stir plate and stirred at 80° C. for 30 minutes. After 30 minutes, the stirring was stopped and the ionic liquid/HTVGO mixtures were allowed to settle for 30 minutes. The HTVGO material was then separated from the ionic liquid and analyzed for S content. Desulfurization ranged from 22.7 to 31.3% depending on the amount of nitrogen remaining in the HTVGO. Results are shown in Table 4.

TABLE 4

| | Hydrotreated VGO Feed 1 | Hydrotreated VGO Feed 4 |
|---|---|---|
| S (wt ppm) | 560 | 184 |
| N (wt ppm) | 74 | 32 |
| de-S | 22.7 | 31.3 |

EXAMPLE 4

In this experiment a 100 gram sample of straight run VGO that had not been previously hydrotreated was combined with 100 grams of tributylethylphosphonium diethylphosphate in a beaker. The mixture was heated on a stir plate and stirred at 80° C. for 30 minutes. After 30 minutes, the stirring was stopped and the ionic liquid/VGO mixture was allowed to settle for 30 minutes. The VGO material was then separated from the ionic liquid and analyzed for S content, 10.6% of the sulfur was removed from the VGO. The extracted VGO was then extracted again with various ionic liquids. In these experiments 10 grams of extracted VGO was combined with 10 grams of ionic liquid. The % de-sulfurization from these experiments is shown in Table 5.

TABLE 5

| | de-sulfurization, wt % |
|---|---|
| 1st stage extraction | |
| tributylethylphosphonium diethylphosphate | 10.6 |
| 2nd stage extraction | |
| tributylmethylphosphonium methylsulfate | 15 |
| 80% tributylethylphosphonium diethylphosphate + tributyldecylphosphonium bromide | 23.7 |
| 80% tributylethylphosphonium diethylphosphate + tetradecyltrihexylphosphonium bromide | 27.5 |

The invention claimed is:

1. A process for removing nitrogen compounds and sulfur compounds from a vacuum gas oil comprising:

(a) contacting the vacuum gas oil comprising the nitrogen and sulfur compounds, with a vacuum gas liquid-immiscible phosphonium ionic liquid to produce a mixture comprising the vacuum gas oil and the vacuum gas liquid-immiscible phosphonium ionic liquid to remove said nitrogen compounds;

(b) then contacting said vacuum gas oil with a vacuum gas oil-immiscible phosphonium ionic liquid to produce a mixture comprising the vacuum gas oil and the vacuum gas liquid-immiscible phosphonium ionic liquid to remove said sulfur compounds; and (c) separating the mixture to produce a vacuum gas oil effluent and a vacuum gas oil-immiscible phosphonium ionic liquid effluent, the vacuum gas liquid-immiscible phosphonium ionic liquid effluent comprising the nitrogen and sulfur compounds wherein said vacuum gas oil is contacted with said vacuum gas liquid-immiscible phosphonium ionic liquid before said vacuum gas oil undergoes hydrotreating.

2. The process of claim 1 wherein the vacuum gas oil-immiscible phosphonium ionic liquid comprises at least one ionic liquid from at least one of tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides.

3. The process of claim 1 wherein the vacuum gas oil-immiscible phosphonium ionic liquid comprises at least one of trihexyl(tetradecyl)phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl) phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, and tetrabutylphosphonium methanesulfonate.

4. The process of claim 1 wherein said vacuum gas oil undergoes additional steps of contact with said vacuum gas oil-immiscible phosphonium ionic liquid and additional hydrotreating until said vacuum gas oil reaches a predetermined content of nitrogen compounds and sulfur compounds.

5. A process for removing nitrogen compounds and sulfur compounds from a vacuum gas oil comprising:

(a) contacting the vacuum gas oil comprising the nitrogen and sulfur compounds, with a vacuum gas liquid-immiscible phosphonium ionic liquid to produce a mixture comprising the vacuum gas oil and the vacuum gas liquid-immiscible phosphonium ionic liquid to remove said nitrogen compounds;

(b) then contacting said vacuum gas oil with a vacuum gas oil-immiscible phosphonium ionic liquid to produce a mixture comprising the vacuum gas oil and the vacuum gas liquid-immiscible phosphonium ionic liquid to remove said sulfur compounds; and (c) separating the mixture to produce a vacuum gas oil effluent and a vacuum gas oil-immiscible phosphonium ionic liquid effluent, the vacuum gas liquid-immiscible phosphonium ionic liquid effluent comprising the nitrogen and sulfur compounds wherein said vacuum gas oil first undergoes hydrotreating, then said vacuum gas oil is contacted with said vacuum gas oil-immiscible phosphonium ionic liquid and then said vacuum gas oil undergoes a second step of hydrotreating.

6. The process of claim 5 wherein said vacuum gas oil undergoes additional steps of contact with said vacuum gas oil-immiscible phosphonium ionic liquid and additional hydrotreating until said vacuum gas oil reaches a predetermined content of nitrogen compounds and sulfur compounds.

7. A process for removing a nitrogen compound and a sulfur compound from a vacuum gas oil comprising:

(a) contacting the vacuum gas oil comprising the nitrogen compound with a VGO-immiscible phosphonium ionic liquid to produce a mixture comprising the vacuum gas oil, and the VGO-immiscible phosphonium ionic liquid to remove said nitrogen compound;

(b) contacting the vacuum gas oil comprising the sulfur compound with a VGO-immiscible phosphonium ionic liquid to produce a mixture comprising the vacuum gas oil, and the VGO-immiscible phosphonium ionic liquid to remove the sulfur compound;

(c) separating the mixture to produce a vacuum gas oil effluent and a VGO-immiscible phosphonium ionic liquid effluent, the VGO-immiscible phosphonium ionic liquid effluent comprising the nitrogen compound, the sulfur compound or mixtures thereof;

(d) washing at least a portion of the vacuum gas oil effluent with water to produce a washed vacuum gas oil stream and a spent water stream;

(e) contacting the VGO-immiscible phosphonium ionic liquid effluent with a regeneration solvent and separating the VGO-immiscible phosphonium ionic liquid effluent from the regeneration solvent to produce an extract stream comprising the nitrogen compound and a regenerated VGO-immiscible phosphonium ionic liquid stream; and (f) drying at least a portion of at least one of the VGO-immiscible phosphonium ionic liquid effluent the spent water stream, and the regenerated VGO-immiscible phosphonium ionic liquid stream to produce a dried VGO-immiscible phosphonium ionic liquid stream wherein said vacuum gas oil is contacted with said vacuum gas oil-immiscible phosphonium ionic liquid before said vacuum gas oil undergoes hydrotreating.

8. The process of claim 7 wherein said vacuum gas oil undergoes additional steps of contact with said vacuum gas oil-immiscible phosphonium ionic liquid and additional hydrotreating until said vacuum gas oil reaches a predetermined content of nitrogen compounds and sulfur compounds.

* * * * *